United States Patent [19]

Tengzelius et al.

[11] 4,190,441

[45] Feb. 26, 1980

[54] POWDER INTENDED FOR POWDER METALLURGICAL MANUFACTURING OF SOFT MAGNETIC COMPONENTS

[75] Inventors: Jan R. Tengzelius, Viken, Sweden; Robert R. Fayles, Moorestown, N.J.

[73] Assignee: Hoganas AB Fack, Hoganas, Sweden

[21] Appl. No.: 882,741

[22] Filed: Mar. 2, 1978

[51] Int. Cl.[2] ..... C22C 38/00; C22C 1/04

[52] U.S. Cl. ..... 75/251

[58] Field of Search ..... 75/251, 0.5 BA, 123 D

[56] References Cited

U.S. PATENT DOCUMENTS 3,836,355 9/1974 Lindskog et al. ..... 75/123 D

*Primary Examiner*—W. Stallard

*Attorney, Agent, or Firm*—Eugene E. Renz, Jr.

[57] ABSTRACT

An improved composition, for the powder metallurgical manufacture by sintering of soft magnetic components which consists essentially of powdered iron and phosphorus. Phosphorus is present in an amount of up to about 1.5% by weight of the composition. The improvement comprises powdered iron at least about 99.8% pure and containing less than about 5% by weight of particles exceeding 35 Tyler mesh (417 μm) and less than about 20% by weight of particles less than 100 Tyler mesh (147 μm), the remainder of the particles being in the range between about 35 and 100 Tyler mesh (417 and 147 μm). The phosphorus content and iron particle size distribution is such that on sintering the composition provides components of satisfactory mechanical strength and having soft magnetic properties about as good as or better than the soft magnetic properties of components made of solid iron of comparable purity.

10 Claims, 5 Drawing Figures

Oe coercive force

1·50
1·40
1·30
1·20
1·10
1·00
10 20 30 40 50 60 70 80 90 100 % by weight

N/mm2 tensile strength 200
150
100
50
10 20 30 40 50 60 70 80 90 100 % by weight % elongation at rupture
15
10
5
10 20 30 40 50 60 70 80 90 100 % by weight
Content of particles having a size less than 100 Tyler mesh

POWDER INTENDED FOR POWDER METALLURGICAL MANUFACTURING OF SOFT MAGNETIC COMPONENTS

The present invention relates to highly pure iron powders having large particle size with the addition of a phosphorus containing powder, especially intended for powder metallurgical manufacturing of components satisfying great demands for soft magnetic properties.

The powder metallurgical manufacturing technique is characterized by long series production of components having good dimensional accuracy. The manufacturing sequence is started by mixing a metallic powder, for example iron powder, if desired containing alloying elements in powder form, with a lubricant in order to simplify the subsequent compression operation. Thereby the powder mixture is compressed to a green compact, the shape of which approximately or exactly corresponds to the shape of the final component. Thereupon the green compact is heated and is retained at a temperature at which the green compact by means of sintering obtains its final characteristics with regard to strength, ductility etc. Substantially, materials manufactured in this way differ from materials manufactured in the melting metallurgical way be their porosity. Components satisfying the demands for good soft magnetic properties are usually manufactured from materials having iron as its main component. The most common manufacturing method is represented by a method wherein the components are manufactured from a piece of highly pure solid material, for example Armcoiron. However, also the powder metallurgical technique is used for the manufacturing of such components because of the advantages of this method with regard to the saving of material, dimensional accuracy and the simplified shaping of the components. However, it has hitherto not been possible to obtain the same good soft magnetic properties of materials manufactured by means of powder metallurgy including iron as the main component as of solid material having the corresponding composition. Substantially, this difference is depended on the porosity of the material manufactured in the powder metallurgical way.

According to the present invention, which is more exactly characterized in the attached claims, it has proved to be possible to obtain with a material manufactured in the powder metallurgical way soft magnetic properties which are about the same as the corresponding properties of highly pure solid iron, i.e. by using as the starting material an iron powder having a sieve analysis which is unusual within powder metallurgy by being moved in the direction of coarse particles. In addition to the fact that this iron powder shall be coarse, there is also required a very low content of impurities.

This highly pure iron powder, which is preferably manufactured by atomization, should have an iron content in excess of 99.8%. Here, as well as in the following, "%" means "weight-%". The contents of impurities, which are known to deteriorate the magnetic properties of iron, should in this iron powder be as low as possible and should preferably be: $C<0.01\%$, $O_{total}<0.01\%$, $N<0.005\%$. In order to obtain the advantages of the present invention, there is used a powder wherein the particle size of the main portion of the particles is between 35 and 100 Tyler mesh (417 and 147 μm), the content of particles greater than 35 Tyler mesh (417 μm) does not exceed 5%, and the content of particles less than 100 Tyler mesh (147 μm) is less than 20%, preferably 10%.

Because of the very low content of particles less than 147 μm, the mechanical properties of components manufactured from this coarse, highly pure powder are very low. If a higher strength is desired, it is not possible to increase the content of particles having a size less than 147 μm without simultaneously deteriorating the soft magnetic properties. A solution to this problem consists in adding a powdered alloying component to the highly pure coarse iron powder, said alloying component producing at the sintering an increased strength without deteriorating the soft magnetic properties of the material thus produced.

It is previously known that ferrophosphorus in powder form which is mixed with the iron powder types normally used within powder metallurgy, there being characterized by a particle size which is less than 147 μm, brings about at sintering an increased strength. See for example Swedish Pat. No. 7205754-0. As appears from the following examples, the addition of ferrophosphorus in powder form to the above highly pure coarse iron powder can make the strength of the sintered material five times higher, thereby not only retaining but even further enhancing the soft magnetic properties. According to the invention the total phosphorus content of the mixture should not exceed 1.5%. The maximum increase of the strength is obtained at a content of 0.3% phosphorus. Preferably, the phosphorus is added as ferrophosphorus powder.

After compression and sintering at conditions normal in connection with powder metallurgical manufacturing, such a powder mixture gives components having good mechanical properties and soft magnetic properties which are better than those of the corresponding material without phosphorus and dependent on the phosphorus content can be even better than the soft magnetic properties of solid highly pure iron.

The invention is further illustrated in the accompanying drawings, wherein.

Figure 1:
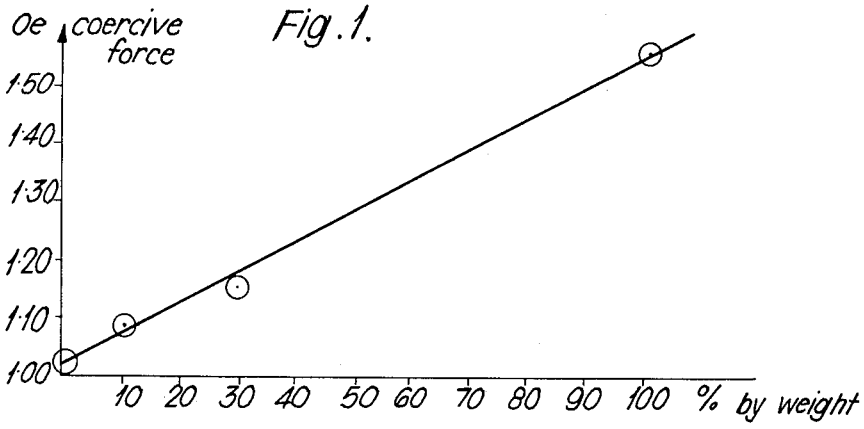
FIG. 1 is a plot of the change in the coercive force of compositions of the invention as the percentage of particles having a size less than 100 Tyler mesh increases from 0 to 100% by weight.

Below the invention is exemplified and the surprising results obtained are reported.

EXAMPLE 1

Two iron powders having different particle size distributions were manufactured by atomizing a highly pure iron melt, drying, after-reduction and sieving. Chemical analysis of these two iron powders gave the following composition: 0.047% O, 0.0004% N., 0.003% S, <0.1% C and balance Fe. The particle size distributions of these iron powders A and B were as follows:

| Iron powder | Sieve analysis >35 | 35–100 | Tyler mesh, %: 100 |
|---|---|---|---|
| A | 1.3 | 97.4 | 1.3 |
| B | 0.0 | 3.6 | 96.4 |

These iron powders were mixed with ferrophosphorus containing 15% phosphorus and having a particle size less than 45 μm, to a phosphorus content of 0.45%. In the following powder A with an addition of 0.45% phosphorus is designated C and powder B with an addition of 0.45% phosphorus is designated D.

The powders A–D mixed with 0.8% zincstearate, were compressed at a pressure of 589 MPa to bars having the dimensions 55×10×10 mm and to tensile test bars. After burning-off the lubricant for 30 minutes at 400° C. in air, the bars were sintered in a belt furnace for 60 minutes at 1120° C. in hydrogen atmosphere. As the coercive force is a relevant measure as to the soft magnetic properties of a material, this was measured by means of a so-called coercimeter. The four materials showed the following coercive forces:

| Material | |
|---|---|
| A | 1.02 Oe |
| B | 1.56 Oe |
| C | 0.89 Oe |
| D | 1.34 Oe |

The above results show the great advantages which are obtained when using a coarse iron powder mixed with phosphorus. The low coercive force value of material C is about the same as the coercive force of Armco-iron which is about 0.9 Oe.

It has also been found that at the same time as the coercive force decreases the resistivity of the material increases when phosphorus is added, which results in decreasing eddy current losses, which means that the total magnetic losses are reduced.

The density, the tensile strength and the elongation at rupture appear from the following table:

| Material | Density g/cm³ | Tensile strength N/mm² | Elongation at Rupture % |
|---|---|---|---|
| A | 7.28 | ~50 | ~5 |
| B | 7.29 | 184 | 15.4 |
| C | 7.24 | 254 | 2.6 |
| D | 7.25 | 400 | 14.0 |

The strength properties given in this example show very low values for material A manufactured from iron powder having a low content of particles with a size less than 147 μm. From the results it can also be seen that an addition of phosphorus to this powder improves the tensile strength about five times.

EXAMPLE 2

An iron powder A according to example 1 was mixed with ferrophosphorus containing 15% phosphorus and having a particle size less than 45 μm to phosphorus contents of from 0.3 to 1.5% P. 0.8% Zn-stearate was added to these mixtures. Test bars were compressed, burned-off and sintered in the same way as described in example 1. The following results were obtained:

| Material | Density g/cm³ | Tensile strength N/mm² | Elongation at rupture % |
|---|---|---|---|
| A + 0.30% P | 7.23 | 265 | 8.6 |
| A + 0.45% P | 7.24 | 254 | 2.6 |
| A + 0.60% P | 7.23 | 240 | 0.9 |
| A + 1.00% P | 7.18 | 234 | 0.7 |
| A + 1.50% P | 7.15 | 150 | 0.5 |
| A + 0% P acc. to example 1 | 7.28 | ~50 | ~5 |

Figure 2:
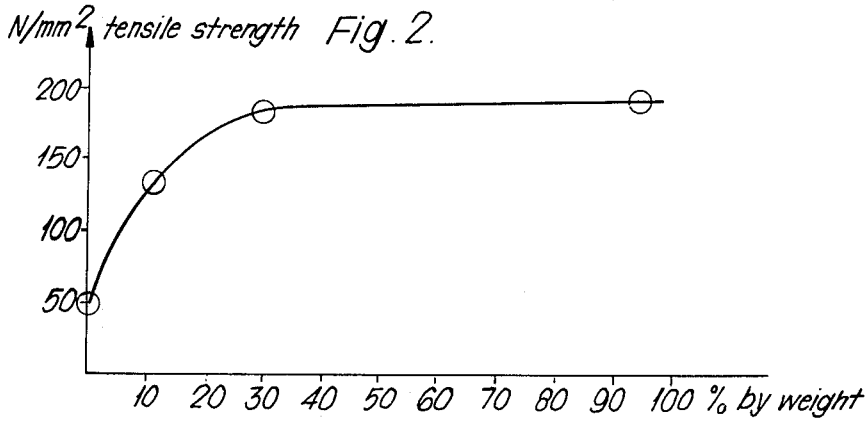
FIG. 2 is a plot of the change in tensile strength of sintered components of the invention as the percentage of particles having a size less than 100 Tyler mesh increases from 0 to 100% by weight.
Figure 3:
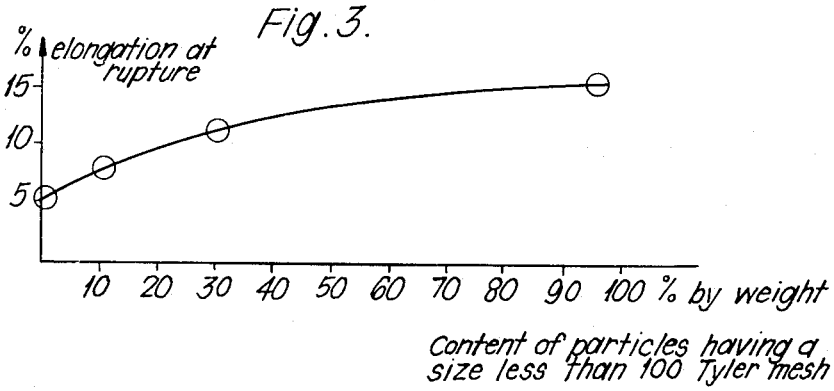
FIG. 3 is a plot of the change in the percent elongation at rupture of sintered components of the invention as the percentage of particles having a particle size less than 100 Tyler mesh increases from 0 to 100% by weight.
Figure 4:
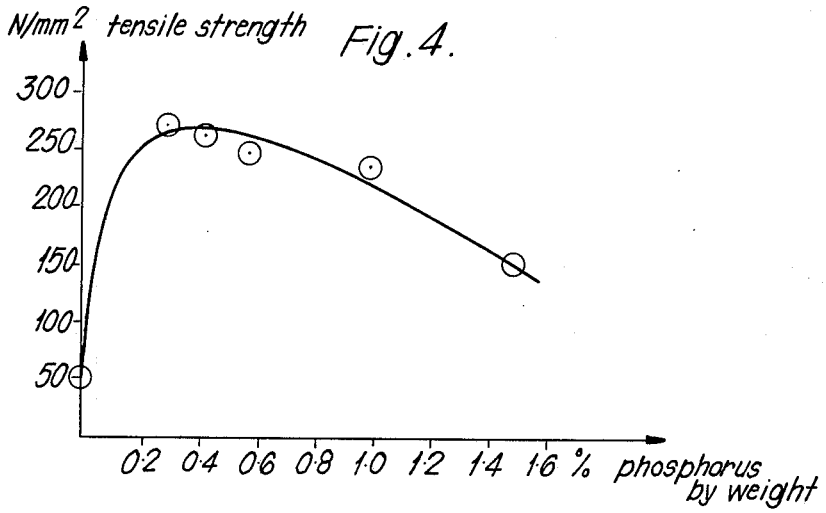
FIG. 4 is a plot of the change in tensile strength of the sintered components of the invention as the content of phosphorus increases from 0.2 to 1.6% by weight.
Figure 5:
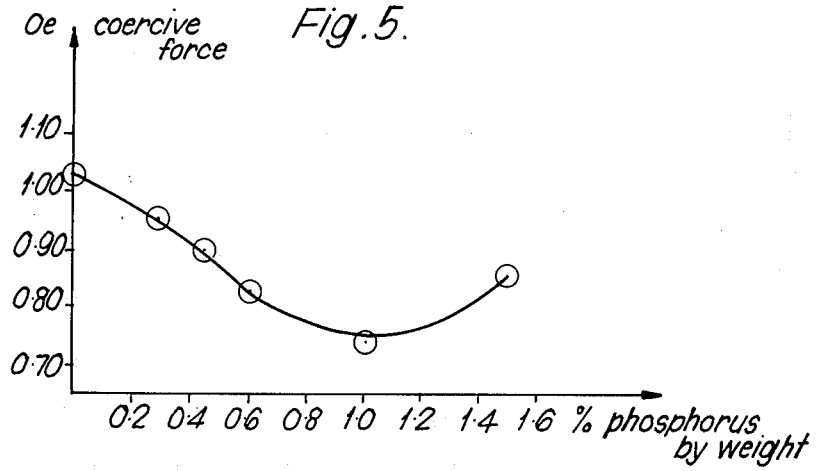
FIG. 5 is a plot of the change in coercive force of the sintered components as the phosphorus content increases from 0.2 to 1.6% by weight. These curves illustrate the critical parameters of the invention.

These results show that the tensile strength of sintered bars having iron powder A as the basic material is substantially increased because of the addition of phosphorus. The fact tht this substantial increase of the tensile strength, which is dependent on the addition of phosphorus has been obtained together with an improvement of the soft magnetic properties appears from the following table and FIGS. 1 and 2, which illustrated the tensile strength and the coercive force, respectively, as a function of the phosphorus content.

| Material | Coercive force Oe |
|---|---|
| A + 0.30% P | 0.95 |
| A + 0.45% P | 0.89 |
| A + 0.60% P | 0.82 |
| A + 1.00% P | 0.73 |
| A + 1.50% P | 0.85 |
| A + 0% P acc. to example 1 | 1.02 |

All these coercive force values are very low and show that this material is extremely well suited for components wherein good soft magnetic properties are desired.

We claim:

1. In an improved composition, for the powder metallurgical manufacture by sintering of soft magnetic components which consists essentially of powdered iron and phosphorus, the latter being present in an amount of up to about 1.5% by weight of said composition, the improvement which comprises: said powdered iron being at least about 99.8% pure and containing less than about 5% by weight of particles exceeding 35 Tyler mesh (417 μm) and less than about 20% by weight of particles less than 100 Tyler mesh (147 μm), the remainder of the particles being in the range between about 35 and 100 Tyler mesh (417 and 147 μm), said phosphorus content and iron particle size distribution being such that on sintering said composition provides components of satisfactory mechanical strength and having soft magnetic properties about as good as or better than the soft magnetic properties of components made of solid iron of comparable purity.

2. A composition according to claim 1 wherein the iron contains less than about 0.01% carbon, less than about 0.1% oxygen, and less than about 0.005% nitrogen, by weight.

3. A composition according to claim 2 wherein the phosphorus content is in the range from about 0.15 to about 1.5% by weight of the composition.

4. A composition according to claim 3 wherein the iron powder contains less than about 10% by weight of particles less than 100 Tyler mesh (147 μm).

5. A composition according to claim 4 wherein the phosphorus content is about 1% by weight of the composition.

6. A composition according to claim 1 wherein the phosphorus is added in the form of ferrophosphorus powder containing about 15% phosphorus by weight and having a particle size less than about 45 μm.

7. A composition according to claim 6 wherein the iron contains less than about 0.01% carbon, less than about 0.1% oxygen, and less than about 0.005% nitrogen, by weight.

8. A composition according to claim 7 wherein the phosphorus content is in the range from about 0.15% to about 1.5% by weight of the composition.

9. A composition according to claim 8 wherein the iron powder contains less than about 10% by weight of particles less than 100 Tyler mesh (147 μm).

10. A composition according to claim 9 wherein the phosphorus content is about 1% by weight of the composition.

* * * * *